United States Patent [19]

McAlarney

[11] 4,138,049

[45] Feb. 6, 1979

[54] DUAL FUNCTION SEALING GASKET

[75] Inventor: Fred R. McAlarney, Seymour, Ind.

[73] Assignee: The Pantasote Company, Greenwich, Conn.

[21] Appl. No.: 737,149

[22] Filed: Oct. 29, 1976

[51] Int. Cl.[2] ..... F16J 15/02; E06B 7/16

[52] U.S. Cl. ..... 277/80; 277/207 R; 49/478; 49/497; 404/65; 296/93

[58] Field of Search ..... 277/207 R, 205, 80, 277/226, 227, 228, 231, 232, 237 R; 404/64, 65; 296/93; 49/475, 478, 488, 496, 497

[56] References Cited

U.S. PATENT DOCUMENTS

| | | | |
|---|---|---|---|
| 3,138,833 | 6/1964 | Neuman | 49/478 |
| 3,178,778 | 4/1965 | Reahard | 277/207 R X |
| 3,184,807 | 5/1965 | Schornstheimer et al. | 49/478 |
| 3,201,833 | 8/1965 | Bryson et al. | 49/478 |
| 3,378,956 | 4/1968 | Parks et al. | 49/497 X |
| 3,595,141 | 7/1971 | Boney et al. | 404/65 |
| 3,682,053 | 8/1972 | Kerschner | 404/65 |
| 3,960,462 | 6/1976 | Kerschner | 404/64 |

FOREIGN PATENT DOCUMENTS

| | | | |
|---|---|---|---|
| 635976 | 2/1962 | Canada | 49/497 |

*Primary Examiner*—Robert S. Ward, Jr.
*Attorney, Agent, or Firm*—Jacobs & Jacobs

[57] ABSTRACT

A resilient, honey-comb extrusion for gaskets for refrigerator doors and the like has a stiff base member, an outer wall over said base member, a lower triangular cell and an upper pentagonal cell. The extrusion can be used to form a compression gasket as is or a magnetic gasket by insertion of a magnetic strip in the pentagonal cell.

5 Claims, 4 Drawing Figures

DUAL FUNCTION SEALING GASKET

This invention relates to resilient gaskets formed of plastic material, and more particularly to gaskets for effecting a compressive seal between two relatively movable members.

While gaskets embodying the invention may advantageously be employed for various purposes, they provide exceptional advantages when used in refrigerators between the door and the cabinet, and hence they will be discussed in connection with such use.

Refrigerator gaskets are either magnetic or compression gaskets.

Magnetic gaskets are generally employed at all but the hinge side of the refrigerator door. These gaskets contain a magnetic strip having a flat surface, and the gasket likewise has a confronting flat surface to enable the magnetic strip securely to contact the sealing surface of the refrigerator and thus act as a magnetic latch. When the gasket is close to the sealing surface, the magnetic strip moves to the sealing surface and stretches the gasket. While air cells have been provided in magnetic gaskets, such cells have been remote from the refrigerator sealing surface and hence do not provide a thermal barrier immediately adjacent the sealing surface. The use of magnetic gaskets is thus prone to "sweating" around the gasket, and a heating means is usually provided around the seal to prevent sweating, but this is wasteful of energy.

The compression gasket forms a seal by being compressed. It should cushion the door on closing, prevent passage of air through the junction between the door and the cabinet after the door has been closed, and provide thermal insulation at such junction. It should perform these functions even though there are irregularities in the surfaces of either or both the door and the cabinet at the junctions.

Moreover, the compression gasket must provide an effective seal and heat barrier, notwithstanding surface irregularities, despite the fact that when the door is closed and opened, the gasket in the vicinity of the hinge is subjected to forces extending transversely of the gasket which tend to impart a wiping action to the gasket. This condition, referred to as "hinge wipe action", is more pronounced when the hinge support for the door is one in which the axis of the hinge pivot is substantially offset from the plane of the cabinet surface to be contacted and sealed by the gasket, as is usually the case in modern refrigerators. These transverse forces and the tendency toward the wiping action occur because, as the door approaches its closed position, the offset pivot axis causes the gasket-supporting surface of the door in the vicinity of the hinge to more transversely of the surface of the cabinet against which the gasket is to press. Such transverse movement may approach 50% of the perpendicular movement during the last few degrees of swinging movement of the door on closing. The hinge wipe action is not involved at the edges remote from the hinge, but rather at these areas in the compressive forces are perpendicular to the gasket. Accordingly, a compression gasket used at the hinge side and a magnetic gasket used remote from the hinge side have generally been constructed quite differently.

In addition to all of the above, the gasket should maintain its resiliency, and should rapidly recover its uncompressed shape when the refrigerator door is opened, throughout a long life, so that it can fully perform the above indicated functions for a long period of use without replacement. It is also necessary that the gaskets should be capable of manufacture and installation at competitive low costs.

The design of the gasket is empirical, and due to the several requirements of the gasket in use and in manufactured, a suitable gasket is quite difficult to obtain. Despite these difficulties, and the conflicting requirements of compression and magnetic gaskets, a new approach to gasket design has been developed by the present invention which provides a resilient flexible sealing gasket that can be used as a magnetic gasket or a compression gasket, which comprises a hollow flexible sealing gasket having a uniform cross-section throughout its length, said gasket being formed of plastic material and comprising in its normal unstressed condition a relatively stiff base member; an outer cell wall extending upwardly from said base member and having spaced side wall portions and a top wall portion; an inner upper central cell wall extending downwardly from said top wall portion, said inner central wall having a pair of spaced side wall portions that downwardly diverge and then downwardly converge until they intersect, said inner central cell wall defining, with said top wall portion, an upper pentagonal central cell with the intersection of said wall portions being the lowest part of the pentagon, said top wall portion being substantially flat between said side wall portions of said inner central cell wall; and two downwardly diverging, inner divider cells walls extending from said intersection of said side wall portions to said base member, said inner divider cell walls defining an inner central lower triangular cell; all of said cell walls being flexible and substantially more flexible than said base member, said cell walls defining said upper pentagonal central cell, said lower triangular central cell and a pair of side cells on either side of said central cells.

For use as a magnetic gasket, the above gasket has a magnetic strip in said pentagonal central cell, said magnetic strip having a flat surface in confronting relationship with said top wall portion.

The present invention is illustrated in terms of a preferred embodiment in the drawings, in which.

Figure 1:
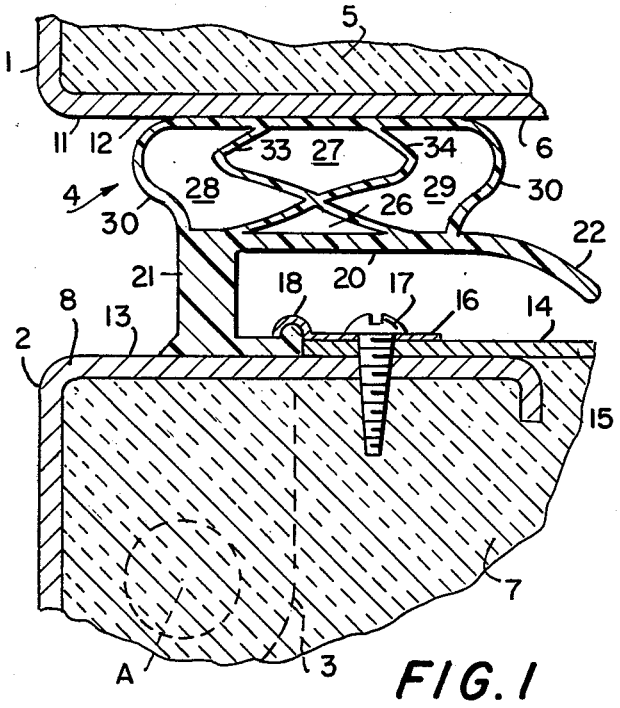
FIG. 1 is a fragmentary horizontal sectional view of a portion of the front hinged side of a refrigerator, showing the cabinet, the refrigerator door, and a compression gasket according to the invention, with the door completely closed and the gasket compressed in sealing relation.

FIG. 1 shows portions of a conventional home refrigerator comprising a cabinet 1 and a door 2 hingedly supported at one edge of the cabinet by hinge means 3, to swing horizontally about the vertical axis A. At the hinge side of the door is a compression gasket 4 embodying the invention. The refrigerator cabinet 1 is constructed in the usual manner with a thick layer of insulating material 5 covered by an outer sheet steel shell 6, and the door 2 is similarly constructed in the conventional manner with a relatively thick insulating layer 7 covered by an outer sheet steel shell 8.

The shell 6 of the cabinet 1 has a flat vertical wall portion 11 extending completely around the door opening to provide planar sealing surface 12 adapted to be engaged by the gasket 4 in sealing relation; the axis A of the hinge means is substantially offset from or spaced in front of this surface. The inner wall of the door shell 8 includes a flat outer peripheral portion 13 and a panel 14 which peripherally overlaps the latter. The wall portion 13 of the door shell 8 is substantially parallel to the wall portion 11 of the cabinet when the door is latched in its fully closed position, as shown in FIG. 1. When the door is in this position, there is a relatively wide space between the wall portions 11 and 13 of the cabinet and door, which space may have a horizontal width of ½" or more in a standard size refrigerator.

A stiffening flange 15 on and integral with the portion 13 of the door shell extends towards the inside of the door and the overlapping edges of the portions 13 and 14 are covered by and carry a sheet metal gasket-holding strip 16 which extends entirely around the door opening to hold the gasket 4 in place. The strip 16 is held in place by screws 17 which are threaded into and also hold together the overlapping edges of the metal wall portions 13 and 14. The gasket-holding strip 16, of uniform cross section, is flat for a major portion of its width, but has a rolled or flanged edge portion 18 of generally arcuate hook-shaped cross section extending outwardly beyond the edge of the wall panel portion 14 for clamping the gasket 4 in place. The rolled edge of the clamping strip provides a channel which receives an edge bead formed integrally on the gasket, locks the latter in predetermined position on and relative to the door, as will appear.

With the exception of the gasket 4, the refrigerator structure described above is conventional.

Figure 2:
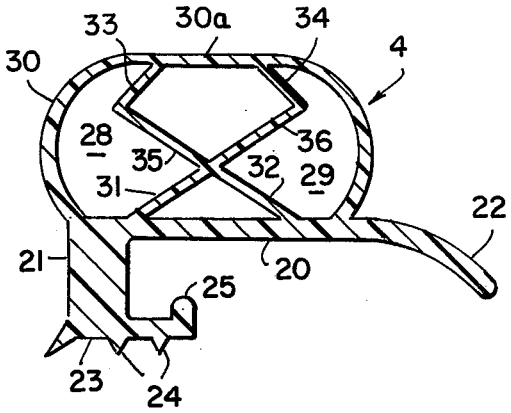
FIG. 2 is a sectional view to an enlarged scale showing the cross-section of the gasket of FIG. 1 before installation.

The compression gasket 4 of the invention, of which the cross-section throughout its length is shown enlarged in FIG. 2, is shaped to function effectively and satisfy all requirements outlined above when made in one piece as an extrusion of one of the pliable plastic materials generally used for refrigerator gaskets, such as homopolymers of vinyl chloride, copolymers of vinyl chloride and vinyl acetate, polyethylene, polyurethane, or similar extruded plastic materials having the necessary flexibility. Various rubbers and rubbery compositions may also be used. The preferred pliable plastic gasket material is a flexible polyvinyl chloride composition embodying a suitable plasticizer and other compounding ingredients such as pigments, fillers, antioxidants, heat and light stabilizers and the like as is well known in the art. The plasticizers preferably include a monomeric plasticizer such as dioctylphthalate, dioctyladipate or the like and/or a polymeric plasticizer such as polyethylene sebacate or the like. As used hereinafter, the term "plastic" when applied to the material of which the gasket is formed is intended to refer to such materials.

FIG. 2 shows the extruded plastic gasket in its normal unstressed condition prior to being mounted on the door 2. For convenience in description of the structure of this gasket, references to directions will be understood as referring to this figure. The gasket is of hollow tubular construction and comprises a substantially flat, stiff generally horizontal wall or base 20 of substantial thickness, having along one edge a downwardly extending anchoring section 21 of generally L-shaped cross section and along its other edge and spaced from the anchoring section, a downwardly extending generally inclined sealing flange 22 with its outer edge generally in alignment with flat lower portion 23 of the anchoring section. This lower portion 23 has on its underside several downwardly projecting ribs 24 adapted to bear in sealing relation against the wall portion 13 of the door, and an upwardly projecting relatively thick fastening rib 25 adapted to be clamped by the hook-shaped portion 18 of the gasket holding strip 16 to hold firmly the gasket 4 in place on the door, as shown in FIG. 1. Anchoring section 21 may be replaced by any other suitable section and forms no part of this invention.

The base 20 of gasket 4 supports four air chambers 26, 27, 28 and 29 defined in relatively thin, flexible walls 30 through 36. In particular, the central, lower triangular chamber 26 is defined by walls 31 and 32. Above the triangular chamber 26 is the upper pentagonal chamber 27 formed by the downwardly diverging walls 33 and 34 and the inwardly diverging walls 35 and 26.

While otherwise curved, the outer wall 30 has a flat portion 30*a* between walls 33 and 34; if desired, this flat portion 30*a* may extend slightly to the left and right of walls 33 and 34, respectively. The juncture between walls 33 and 35 and 34 and 36, respectively, takes the form of an abrupt corner.

The action of the gasket in cushioning closing of a refrigerator door, sealing against passage of air and providing a heat barrier after the door has been closed, is illustrated in FIG. 1. When the refrigerator door is closing, the outwardly curved central or top wall 30 of the gasket first contacts the wall surface 12 of the refrigerator cabinet at the hinge side of the door opening. As the door swings further to its completely closed position, shown in FIG. 1, the gasket is subjected to the previously mentioned transverse forces. However, due to its construction, the gasket yields transversely while contriving to exert forces resiliently resisting distortion and compression, and thus providing a good seal.

The structure of the gasket thus prevents leakage of air or impairment of heat insulation properties which could result from wrinkling, or abrasion and wear, of the gasket at the hinge of the door on closing. The transverse distortion of the gasket at the hinge side of the refrigerator opening when the door is in its closed position does not prevent a good seal. There is a wide area of gasket making good sealing contact with the cabinet, as shown in FIG. 1, and there are four walls, viz. walls 30, 34, 33 and 30 again, and three cells, viz. 29, 27 and 28, through which cold air must pass as it attempts to leak out of the refrigerator along the interface of gasket 4 and wall surface 12. The outwardly curved arcuate top wall 30 facilitates fitting of the gasket over and into irregularities in the confronting sealing surface 12.

It will be apparent that the advantages of gaskets embodying the invention will be most fully realized if the gasket size and shape is selected in view of the space present between the door and the cabinet of the refrigerator, and the amount of the hinge offset.

Figure 3:
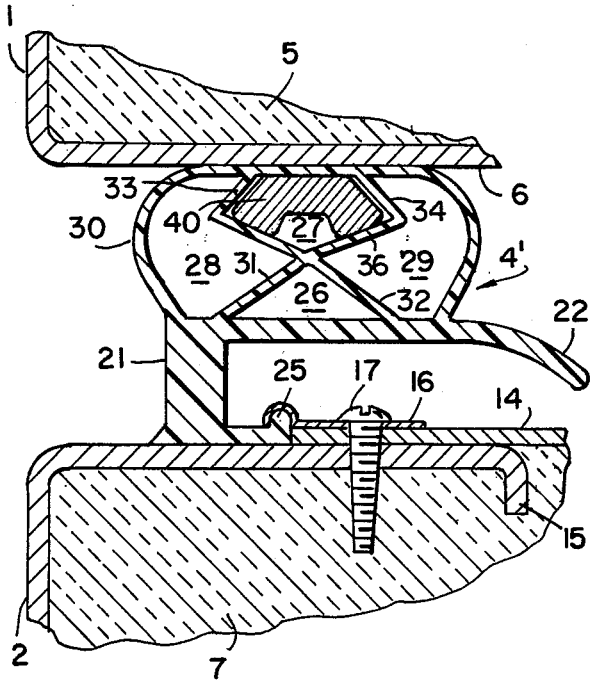
FIG. 3 is a fragmentary horizontal sectional view of a portion of the unhinged side of a refrigerator, showing the cabinet, the refrigerator door and a magnetic gasket according to the invention, with the door completely closed and the gasket in sealing relation.
Figure 4:
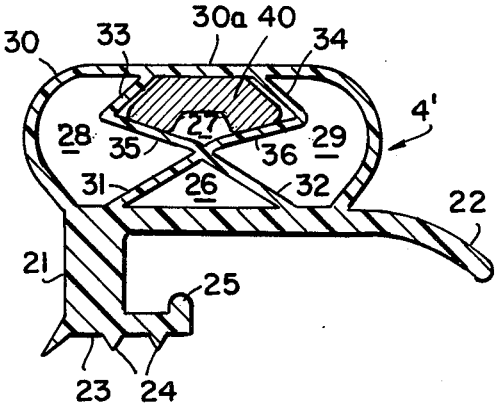
FIG. 4 is a sectional view, similar to that of FIG. 2, showing the cross-section of the gasket of FIG. 3 before installation.

Gasket 4 will be employed at least at the hinge side of the refrigerator door 2. At one or more, preferably all three, of the remaining sides of the door 2, a magnetic gasket 4' will be used, the four gaskets (4 and 4') being mitred and spliced together to form a square or rectangular door gasket. FIGS. 3 and 4 show the use of the magnetic gasket 4'. As can be seen from FIG. 4, the magnet gasket 4' is identical to gasket 4 of FIGS. 1 and 2, and like numbers denote like parts. Indeed, both gaskets 4 and 4' are formed from the same material using the same extrusion die. Preferably, air is drawn out of the die during the extrusion to partially deflate the cells, thereby causing the gasket 4' to sag slightly and hence to be slightly shorter in height than the gasket 4. Magnetic gaskets reach out to the surface to be sealed, and therefore gasket 4' must be able to stretch under sealing conditions. Magnetic insert 40 is a conventional magnetic strip formed by extrusion of a magnetic material, e.g. barium ferrite, in a binder, e.g. a rubber binder.

When the gasket 4' is in the stretched position shown in FIG. 3, the flat wall portion 30*a* permits magnetic strip 40 to be parallel to the sealing surface 12 and hence in good magnetic latching relationship and, in addition, acts as an effective thermal barrier by virtue of the cells 26, 28 and 29. Furthermore, cell 27 also has some air and hence it, too, offers thermal insulation. As in the case of gasket 4, magnetic gasket 4' prevents leakage of cold air out of the refrigerator and the sweating observed with conventional magnetic gaskets is eliminated, without the need for a heating means.

In gasket 4, the inner walls 31 through 36 act as a spring urging wall 30 to its normal position shown in FIGS. 2 and 4, and hence gasket 4 offers excellent recovery from compression set. Although none of the walls 30–36 is stiff, nevertheless the curvature of wall 30, the spring-like character of walls 31–36 and the triangularity of cell 26 together coact to enable the gasket 4 to resist the lateral deformation caused by the hinge wipe action. Further, since the gaskets 4 and 4' differ primarily only in the presence or absence of the magnetic strip 40, the same extrusion die is used to prepare both gaskets, the same mitre device is used to cut both gaskets and the same splicing apparatus is used for splicing any pair of gaskets, whether the same or different. Gasket 4 effectively resists hinge action wipe and is converted to magnetic gasket 4' merely by addition of the magnetic strip 40, which in turn has the flat surface 30*a* required for such gaskets. Hence, the present invention provides a single extrusion meeting the requirements of a magnetic gasket and a pneumatic gasket, which results in economies in equipment used to make the extrusions and the final door gaskets therefrom.

What is claimed is:

1. A hollow flexible sealing gasket having a uniform cross-section throughout its length, said gasket being formed of plastic material and comprising in its normal unstressed condition a relatively stiff base member;

an outer cell wall extending upwardly from said base member and having spaced side wall portions and a top wall portion;

an inner upper central cell wall extending downwardly from said top wall portion, said inner central wall having a pair of spaced side wall portions that downwardly diverge and then downwardly converge until they intersect, said inner central cell wall defining, with said top wall portion, an upper pentagonal central cell with the intersection of said wall portions being the lowest part of the pentagon, said top wall portion being substantially flat between said side wall portions of said inner central cell wall; and two downwardly diverging, inner divider cell walls extending from said intersection of said side wall portions to said base member, said inner divider cell walls defining an inner central lower triangular cell;

all of said cell walls being flexible and substantially more flexible than said base member, said cell walls defining said upper pentagonal central cell, said lower triangular central cell and a pair of side cells on either side of said central cells.

2. The gasket according to claim 1, wherein the divider cell walls are at least substantially symmetrically disposed about a plane perpendicular to said base member and passing through the line of intersection of said side wall portions.

3. The gasket according to claim 1, wherein said plastic material is a polymer of vinyl chloride.

4. The gasket according to claim 1, having an elongated magnetic strip in said pentagonal central cell, said magnetic strip having a flat surface in confronting relationship with said top wall portion.

5. The gasket according to claim 4, wherein said magnetic strip does not entirely fill said pentagonal central cell.

* * * * *